US009244407B2

(12) United States Patent
Matsumoto et al.

(10) Patent No.: US 9,244,407 B2
(45) Date of Patent: Jan. 26, 2016

(54) FIXING MEMBER WITH ALKALI METAL ION, IMAGE HEAT FIXING APPARATUS, AND ELECTROPHOTOGRAPHIC IMAGE FORMING APPARATUS

(71) Applicant: CANON KABUSHIKI KAISHA, Tokyo (JP)

(72) Inventors: Mamo Matsumoto, Hiratsuka (JP); Masahito Omata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 55 days.

(21) Appl. No.: 13/955,395

(22) Filed: Jul. 31, 2013

(65) Prior Publication Data

US 2014/0037349 A1 Feb. 6, 2014

(30) Foreign Application Priority Data

Aug. 2, 2012 (JP) ..... 2012-172347
Jun. 21, 2013 (JP) ..... 2013-131199

(51) Int. Cl.
*G03G 15/20* (2006.01)

(52) U.S. Cl.
CPC ..... *G03G 15/206* (2013.01); *G03G 15/2035* (2013.01); *G03G 2215/2035* (2013.01)

(58) Field of Classification Search
CPC ..... G03G 15/2053; G03G 15/206
USPC ..... 399/328–330, 333
See application file for complete search history.

(56) References Cited

U.S. PATENT DOCUMENTS

2007/0197362 A1* 8/2007 Sakata et al. ..... 492/49
2007/0253726 A1* 11/2007 Kagawa ..... 399/100
2008/0292366 A1* 11/2008 Akama et al. ..... 399/286
2013/0259548 A1* 10/2013 Matsumoto et al. ..... 399/333
2014/0227526 A1* 8/2014 Egawa ..... 428/411.1

FOREIGN PATENT DOCUMENTS

JP 2006-336668 A 12/2006

* cited by examiner

*Primary Examiner* — G. M. Hyder
(74) *Attorney, Agent, or Firm* — Canon U.S.A. Inc., IP Division

(57) ABSTRACT

This invention provides a fixing member whose hardness is not easily changed even when used for a long period of time and which has high endurance. The fixing member has a substrate, an elastic layer, and a surface layer in this order, in which the elastic layer contains silicone rubber, a thermally conductive filler containing alkali metal ions, and a compound having a phosphate group in the molecule.

11 Claims, 3 Drawing Sheets

FIXING MEMBER WITH ALKALI METAL ION, IMAGE HEAT FIXING APPARATUS, AND ELECTROPHOTOGRAPHIC IMAGE FORMING APPARATUS

BACKGROUND OF THE INVENTION

1. Field of the Invention

The present invention relates to a fixing member and an image heat fixing apparatus and an electrophotographic image forming apparatus employing the fixing member.

2. Description of the Related Art

Heretofore, an electrophotographic image forming apparatus, such as a copying machine, a printer, and a facsimile equipment, has been provided with an image heat fixing apparatus in some cases.

Herein, the image heat fixing apparatus is an apparatus which heat-treats a recording material bearing an image with heat and pressure. As such an image heat fixing apparatus, a fixing apparatus which heat-treats an unfixed toner image on a recording material to fix or temporarily fix the toner image is mentioned. Moreover, a gloss increasing apparatus which heat-treats an image fixed on a recording material to increase the gloss of the image, an apparatus which heat-treats a recording material on which an image is formed by ink jet to dry the image, and the like are mentioned.

The image heat fixing apparatus is provided with a fixing member having an elastic layer containing silicone rubber and a thermally conductive filler dispersed in the silicone rubber. As the fixing member, a fixing roller, a fixing film, a pressure roller, and the like are mentioned.

As the thermally conductive filler, although alumina or zinc oxide has been frequently used, all the thermally conductive fillers contain alkali metal ions as impurities.

The fixing member in the image heat fixing apparatus is heated to a high temperature (generally a temperature of about 200° C. to about 250° C.). In such a case, it is known that when alkali metal ions, particularly sodium ions, are present in silicone rubber forming an elastic layer, the heat resistance of the silicone rubber is adversely affected (refer to Japanese Patent Laid-Open No. 2006-336668). Specifically, the hardness of the silicone rubber significantly changes due to cutting of a crosslinked portion of the silicone rubber, reconnection of the cut portions, and the like. In particular, when the addition amount of the thermally conductive filler relative to the silicone rubber in the elastic layer is increased in order to increase the thermal conductivity of the elastic layer, the instability of the hardness of the elastic layer becomes more noticeable.

In order to address the problem, Japanese Patent Laid-Open No. 2006-336668 proposes compounding zinc oxide whose sodium content is small and whose average particle diameter is 1 to 50 μm as the thermally conductive filler.

However, the use of the thermally conductive filler proposed in Japanese Patent Laid-Open No. 2006-336668 has caused a cost increase. Moreover, there has been a problem in that usable thermally conductive fillers have been limited.

SUMMARY OF THE INVENTION

Then, the present invention is directed to providing a fixing member whose hardness is difficult to change even when used for a long period of time and which has high endurance.

The present invention is also directed to providing an image heat fixing apparatus whose thermal fixability is stable for a long period of time and an electrophotographic image forming apparatus employing the image heat fixing apparatus.

According to one aspect of the invention, there is provided a fixing member having a substrate, an elastic layer, and a surface layer in this order, in which the elastic layer contains silicone rubber, a thermally conductive filler containing an alkali metal ion, and a compound having a phosphate group in the molecule.

According to another aspect of the present invention, there is provided an image heat fixing apparatus having the above-described fixing member, a unit configured to heat the fixing member, and a pressure member opposingly disposed to the fixing member.

According to further aspect of the present invention, there is provided an electrophotographic image forming apparatus having the above-described image heat fixing apparatus.

Further features of the present invention will become apparent from the following description of exemplary embodiments with reference to the attached drawings.

DESCRIPTION OF THE EMBODIMENTS

When a fixing member provided with an elastic layer containing silicone rubber and a thermally conductive filler containing an alkali metal ion is used for a long period of time, the hardness of the elastic layer changes, resulting in a change in the fixing capability, which is considered to occur the following causes.

More specifically, the alkali metal ion contained as an impurity in the thermally conductive filler, specifically sodium ion, moves in the elastic layer heated to a high temperature to thereby cut the molecular chains of the silicone rubber to reduce the molecular weight of the silicone rubber in the elastic layer. On the other hand, when the cutting of the molecular chains of the silicone rubber proceeds to some extent, the cut silicone rubbers are reconnected in the elastic layer. It is considered that since such a reduction in the molecular weight of the silicone rubber and such a reconnection of the lower molecular weight silicone rubbers proceed in a competitive manner in the heated elastic layer, the hardness of the elastic layer temporally fluctuates.

Herein, the present inventors have found that the cutting of the molecular chains forming the crosslinked structure of the silicone rubber can be suppressed by reducing the opportunity when the alkali metal ions contact the silicone molecular chains in the elastic layer, even when the amount of the alkali metal ions in the elastic layer is not reduced.

Specifically, the present inventors have found that the thermal degradation of the silicone rubber can be suppressed by providing a capturing site of the alkali metals ion in the elastic layer, and letting the capturing site capture the alkali metal ion to thereby reduce the contact opportunity of the alkali metal ions and the silicone rubber.

Figure 1:
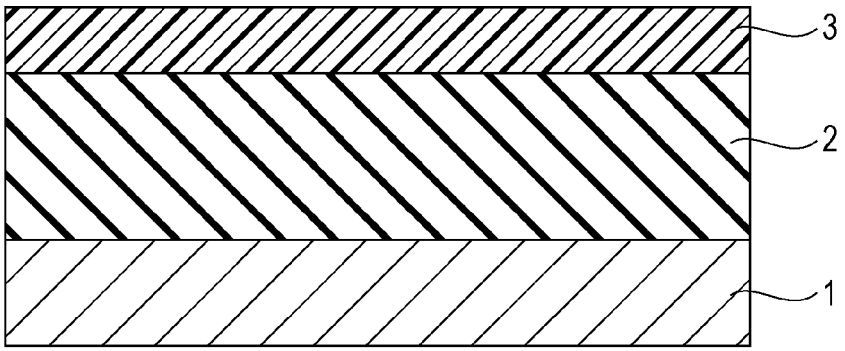
FIG. 1 is a schematic cross sectional view of a fixing belt which is one aspect of a fixing member according to the invention.

(1) Configuration of Fixing Member;

FIG. 1 is a schematic cross sectional view of a fixing belt which is one aspect of the fixing member according to the invention. FIG. 1 includes a substrate 1, a cured silicone rubber elastic layer 2 covering the circumferential surface of the substrate 1, and a fluororesin surface layer 3. The fixing member according to the invention is similarly applicable to a fixing roller and a pressure member.

(2) Substrate;

As the substrate, metals such as aluminum, iron, stainless steel, and nickel, and alloys thereof, and a heat-resistant resin, such as polyimide, are used, for example. When the fixing member has a belt shape, an electrocast nickel belt, a heat-resistant resin belt containing polyimide or the like, and a metal or alloy belt containing stainless steel or the like are mentioned, for example. When the fixing member has a roller shape, such as a fixing roller or a pressure roller, a mandrel is used. As the material of the mandrel, metals such as aluminum, iron, and stainless steel and alloys thereof are mentioned, for example. For adhesion with the cured silicone rubber elastic layer, primer treatment may be performed prior to the formation of the cured silicone rubber elastic layer.

(3) Elastic Layer and Manufacturing Method Therefor;

The elastic layer has a function for imparting flexibility to the fixing member in such a manner that toner on paper is not excessively crushed in fixing. As the main constituent component of the elastic layer, silicone rubber having excellent heat resistance is used. On the other hand, the elastic layer is demanded to have high thermal conductivity in order to sufficiently transmit heat from the substrate toward the surface layer. Therefore, a thermally conductive filler is compounded in the elastic layer.

For the formation of the elastic layer, an addition curable silicone rubber mixture is suitably used. This is because the elasticity can be adjusted by adjusting the crosslinking degree according to the type and the addition amount of a filler described later.

(3-1) Addition Curable Silicone Rubber Mixture;

In general, the addition curable silicone rubber mixture contains organopolysiloxane having an unsaturated aliphatic group, organopolysiloxane having active hydrogen atoms bonded to silicon, and a platinum compound as a catalyst for crosslinking. As a specific example of the organopolysiloxane having an unsaturated aliphatic group, the following substances are mentioned.

Straight-chain organopolysiloxane having a structure in which both molecule ends are represented by $(R^1)_2R^2SiO_{1/2}$ and the middle unit is represented by at least one of $(R^1)_2SiO_{2/2}$ and $R^1R^2SiO_{2/2}$; and Branched-chain organopolysiloxane having a structure in which both molecule ends are represented by $(R^1)_2R^2SiO_{1/2}$ and the middle unit is represented by at least one of $R^1SiO_{3/2}$ and $SiO_{4/2}$.

Herein $R^1_s$ represent unsubstituted or substituted monovalent hydrocarbon groups which are bonded to silicon atoms and do not contain aliphatic unsaturated groups.

Specific examples of $R^1$ are mentioned below. Alkyl groups (e.g., methyl, ethyl, propyl, butyl, pentyl, hexyl, and the like);

Aryl groups (phenyl group and the like); and

Substituted hydrocarbon groups (e.g., chloromethyl, 3-chloropropyl, 3,3,3-trifluoropropyl, 3-cyanopropyl, 3-methoxypropyl, and the like).

In particular, since the synthesis and the handling are easy and outstanding heat resistance is obtained, it is suitable that 50% or more of $R^1$s are methyl groups and it is particularly suitable that all $R^1$s are methyl groups. $R^2$s represent unsaturated aliphatic groups bonded to silicon atoms and include vinyl, allyl, 3-butenyl, 4-pentenyl, and 5-hexenyl as an example. Since the synthesis and the handling are easy and a crosslinking reaction is also easily achieved, vinyl is suitable.

The organopolysiloxane having active hydrogen atoms bonded to the silicon atom is a crosslinking agent which forms a crosslinked structure by a reaction with an alkenyl group of the organopolysiloxane component having an unsaturated aliphatic group due to a catalytic action of the platinum compound. The number of the hydrogen atoms bonded to the silicon atoms is a number which exceeds an average number of 3 in one molecule. As an organic group bonded to the silicon atom, the same unsubstituted or substituted monovalent hydrocarbon groups as those of $R^1$ of the organopolysiloxane component having an unsaturated aliphatic group are mentioned as an example. In particular, since the synthesis and the handling are easy, a methyl group is suitable.

The molecular weight of the organopolysiloxane having active hydrogen atoms bonded to the silicon atom is not particularly limited. The kinetic viscosity at a temperature of 25° C. of the organopolysiloxane is suitably in the range of 10 $mm^2/s$ or more and 100,000 $mm^2/s$ or lower and more suitably in the range of 15 $mm^2/s$ or more and 1000 $mm^2/s$ or lower. This is because a failure of obtaining a desired crosslinking degree or desired physical properties of molded articles due to volatilization during storage does not arise, the synthesis and the handling are easy, and easy and uniform dispersion in a system can be achieved.

The siloxane skeleton may be a straight-chain shape, a branched-chain shape, or a ring shape and a mixture thereof may be used. In particular, since the synthesis is easy, a straight-chain shape is suitable. Although Si—H bonds may be present in any siloxane unit in the molecule, it is suitable that at least one part thereof is present in a siloxane unit at the molecule end, such as an $R^1{}_2HSiO_{1/2}$ unit. As for the addition curable silicone rubber mixture, the amount of the unsaturated aliphatic group is suitably 0.1% by mol or more and 2.0% by mol or lower and particularly suitably 0.2% by mol or more and 1.0% by mol or lower per mol of the silicon atoms.

It is suitable to set the compounding ratio in such a manner that the rate of the number of active hydrogen atoms to the unsaturated aliphatic group is 0.3 or more and 0.8 or lower. By setting the rate in the numerical value range mentioned above, the hardness of the silicone rubber elastic layer after curing is made stable and an excessive increase in hardness can be suppressed.

The rate of the number of active hydrogen atoms to the unsaturated aliphatic group can be quantified and calculated by a measurement using a hydrogen nuclear magnetic resonance analysis (e.g., $^1$H-NMR (trade name: AL400 type FT-NMR; manufactured by JEOL Co., Ltd.).).

(3-2) Filler;

The elastic layer according to the invention contains a thermally conductive filler for imparting thermal conductivity to the elastic layer. In addition, a reinforcement filler, a processability improvement agent, a heat-resistant agent, a fire retardant, a hardness reducing agent, and the like can be compounded insofar as the advantages of the invention are not impaired.

(3-2-1) Thermally Conductive Filler

As the thermal conductivity filler, either or both of alumina or/and zinc oxide can be used, for example. Herein, these thermally conductive fillers contain alkali metal ions, particularly sodium ions, as impurities. These ions are inevitably taken in a manufacturing stage.

As silicone rubber containing such a thermally conductive filler, silicone rubber with a sodium ion content of ppm order is common. The content of the alkali metal ions in a high thermally-conductive silicone rubber can be quantitatively determined by a liquid chromatography by measuring the concentration of ions eluted from a test sample in boiling water.

The average particle diameter of the thermally conductive filler is suitably 1 μm or more and 50 μm or lower from the viewpoint of handling and dispersibility. Examples of the shape include a spherical shape, a pulverized shape, a needle shape, a plate shape, and a whisker shape, and among them, a spherical shape is suitable from the viewpoint of dispersibility. Herein, the average particle diameter is calculated based on data obtained by measuring diameters of 400 thermally conductive filler particles that are randomly selected from an image taken by a transmission electron microscope. As for the particle diameter, the major axis of particles is measured, the average value is defined as the measured value when the major axis/minor axis ratio is 2 or more, and then the particle diameter is calculated from these values.

The content of the thermally conductive filler in the high thermally-conductive silicone rubber is suitably 35% by volume or more and 60% by volume or lower based on the cured silicone rubber elastic layer in order to sufficiently achieve the purpose.

(3-2-2) Other Fillers

As the filler, those which have been generally used according to the purpose can be added to the components mentioned above as long as the advantages of the invention are not impaired. Examples of such fillers are mentioned below.

Silica fillers, such as pulverized quartz and diatomite, and processability auxiliary agents for imparting processability;

Various additives;

Metal oxides (e.g., titanium oxide, iron oxide, cerium oxide, vanadium oxide, chromium oxide, and the like);

Pigments, heat-resistant agents, fire retardants, hardness reducing agents such as dimethyl silicone oil, and the like.

(3-3) Compound Having Phosphate Group in Molecule;

The elastic layer according to the invention further contains a compound having a phosphate group in the molecule (hereinafter also simply referred to as a "phosphate compound") in order to suppress thermal degradation of a cured silicone rubber due to an action of the alkali metal ions contained in the elastic layer. The phosphate compound captures the alkali metal ions in the elastic layer, particularly sodium ions, to suppress cutting of the molecular chains of the silicone rubber caused by the sodium ions.

The temperature of the elastic layer when fixing is 200° C. or higher. Therefore, the phosphate compound according to the invention is suitably one which is not decomposed when heated to a temperature of 220° C. or higher and suitably a temperature of 250° C. or higher. As such a phosphate compound, zirconium phosphate and fluororesin to which a phosphate group is bonded are mentioned.

The fluororesin to which a phosphate group is bonded is a fluororesin to which a group containing a phosphate group is bonded, and is mentioned in PCT Japanese Translation Patent Publication No. 2002-514181, Japanese Patent No. 2882579, and Japanese Patent Laid-Open No. 2005-212318.

As an example of the fluororesin, a copolymer obtained by copolymerizing tetrafluoroethylene (TFE) and at least one kind of fluorine-substituted comonomer by a known method can be mentioned. As the fluorine-substituted comonomer, perfluoroalkyl vinyl having carbon atoms of 3 or more and 8 or less and perfluoroalkyl vinyl ether (PAVE) in which the number of carbon atoms of an alkyl group is 1 or more and 5 or lower can be mentioned.

The fluororesin having a phosphate group can be obtained by copolymerizing fluorinated monomers having a pendant type side group containing a functional group unit when manufacturing the fluororesin by polymerization, for example. As a suitable example of the fluorinated monomer having a phosphate group, a dihydrogen phosphate ester compound containing a trifluorovinyl ether group can be mentioned.

As a specific example thereof, 2,2,3,3,5,6,6,8,9,9-decafluoro-5-trifluoromethyl-4,7-dioxanona-8-en-1-yl dihydrogen phosphate (EVE-P) can be mentioned. Moreover, 2,2,3,3,4,4,6,7,7-nonafluoro-5-oxahepta-6-en-1-yl dihydrogen phosphate can be mentioned.

The fluororesin having a phosphate group according to the invention can be obtained by copolymerizing the fluorinated monomer having a phosphate group, TFE, and at least one kind of fluorine-substituted comonomer by a known method.

The fluororesin can also be obtained by copolymerizing TFE having a phosphate group and at least one kind of fluorine-substituted comonomer by a known method. In particular, a tetrafluoroethylene-perfluoroalkyl vinyl ether copolymer having a phosphate group is suitably used in terms of having excellent heat resistance.

The melting point of the fluororesin having a phosphate group is a temperature of 220 to 300° C. and suitably a temperature of 250 to 300° C. Therefore, the proportion of the alkyl vinyl ether component or the alkyl vinyl component is 3% by mol or more and 12% by mol or lower and suitably 3% by mol or more and 10% by mol or lower relative to the copolymer resin. One in which the amount of the phosphate group is 0.02% by mol or more and 5% by mol or lower and suitably 0.1% by mol or more and 2.5% by mol or lower is suitably used. As the compounding amount, in order to sufficiently achieve the purpose, it is desirable to compound the fluororesin in the high thermally-conductive silicone rubber in a proportion of 0.2% by mass or more and 10% by mass or lower and suitably 0.5% by mass or more and 5% by mass or lower.

(3-4) Thickness of Elastic Layer;

When the fixing member is a fixing belt, the thickness of the cured silicone rubber elastic layer is 100 μm or more and 500 μm or lower and particularly suitably 200 μm or more and 400 μm or lower in terms of the contribution to the surface hardness and the efficiency of the thermal conduction to an unfixed toner in fixing.

When the fixing member is a fixing roller, the thickness of the cured silicone rubber elastic layer is 0.5 mm or more and 5 mm or lower and particularly suitably 2 mm or more and 4 mm or lower in terms of the contribution to the roller hardness for obtaining a sufficient nip width in order to fix toner and the efficiency of the thermal conduction to an unfixed toner.

When the fixing member is a pressure roller, an arbitrary thickness may be acceptable insofar as a sufficient nip width can be obtained in order to fix toner. The thickness is generally 0.5 mm or more and 4 mm or lower.

(3-5) Manufacturing Method of Elastic Layer;

The cured silicone rubber elastic layer can be formed by a known method. A coat is formed on a substrate by a ring coating method, a casting method, or the like, and then heated for a fixed period of time by a heating unit, such as an electric furnace, to advance a crosslinking reaction to be able to be formed into the cured silicone rubber elastic layer.

(4) Surface Layer (4-1) Fluororesin Primer

For adhesion of a surface layer containing a fluororesin and the cured silicone rubber elastic layer, a primer layer may be provided between these two layers. Furthermore, prior to the application of the fluororesin primer, the cured silicone rubber elastic layer surface can also be subjected to UV treatment and silane coupling agent treatment.

(4-2) Surface Layer

The surface layer containing a fluororesin can be formed by a known method. Specifically, the following methods are mentioned.

Method including covering the circumferential surface of the elastic layer formed on the circumferential surface of a mandrel as a substrate with a fluororesin tube formed by extrusion molding; and Method including applying fluororesin particles by a spray or the like to be attached to the surface of the elastic layer, and then melting the fluororesin particle to form a a film.

As the fluororesin, a tetrafluoroethylene-perfluoroalkyl vinyl ether copolymer (PFA), polytetrafluoroethylene (PTFE), a tetrafluoroethylene-hexafluoropropylene copolymer (FEP), and the like can be used, for example. Among the materials mentioned above, PFA is suitable from the viewpoint of moldability and toner releasability. Moreover, two or more kinds of the materials mentioned above may be blended and used. Additives may be added insofar as the advantages of the invention are not impaired.

It is suitable that the thickness of the surface layer is 5 μm or more and 50 μm or lower and more desirably 10 μm or more and 30 μm or lower.

(5) Image Heat Fixing Apparatus

Figure 2:
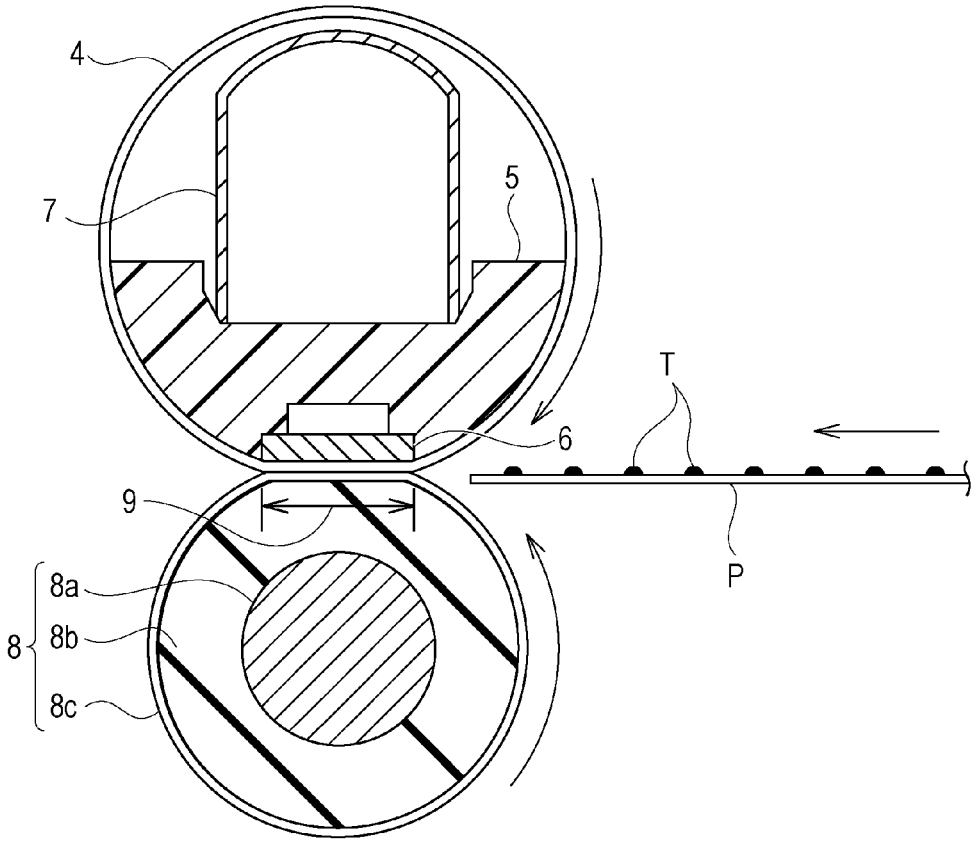
FIG. 2 is a schematic cross sectional view of an image heat fixing apparatus according to the invention.

FIG. 2 is a cross-sectional schematic configuration view of an image heat fixing apparatus employing the fixing member according to the invention. FIG. 2 includes a seamless fixing belt 4.

In order to hold the fixing belt 4, a belt guide member 5 molded with a heat-resistant and heat insulating resin is formed. A ceramic heater 6 as a heat source is provided at a position where the belt guide member 5 and the inner surface of the fixing belt 4 contact each other. The ceramic heater 6 is engaged in a groove portion provided by molding along the longitudinal direction of the belt guide member 5 to be fixed and supported, and is energized by a unit, which is not illustrated, to generate heat. The fixing belt 4 is loosely fitted onto the belt guide member 5. A pressure rigid stay 7 is inserted into the belt guide member 5.

An elastic pressure roller 8 as the pressure member is one in which the surface hardness is reduced by providing a silicone rubber elastic layer 8*b* to a stainless steel core metal 8*a*. Both end portions of the core metal 8*a* are rotatably held by a bearing between chassis side plates at the front side and the back side, which are not illustrated, and opposingly disposed to the fixing member. The elastic pressure roller 8 is covered with a 50 μm fluororesin tube as a surface layer 8*c* in order to increase the surface properties and releasability.

By providing a pressure spring (not illustrated) in a compressed state between each of both end portions of the pressure rigid stay 7 and a spring receiving member (not illustrated) at the apparatus chassis side, pressing-down force is applied to the pressure rigid stay 7. Thus, the lower surface of the ceramic heater 6 as the heating unit disposed on the lower surface of the belt guide member 5 and the upper surface of the elastic pressure roller 8 are pressed against each other with the fixing belt 4 interposed therebetween, whereby a predetermined fixing nip portion 9 is formed. To the fixing nip portion 9, a recording medium P serving as a heating target on which an image is formed with an unfixed toner T is pinched and conveyed. Thus, the toner image is heated and pressurized. As a result, the toner image is melted, undergoes color mixing, and then cooled, whereby the toner image is fixed onto the recording medium P.

(6) Electrophotographic Image Forming Apparatus

Figure 3:
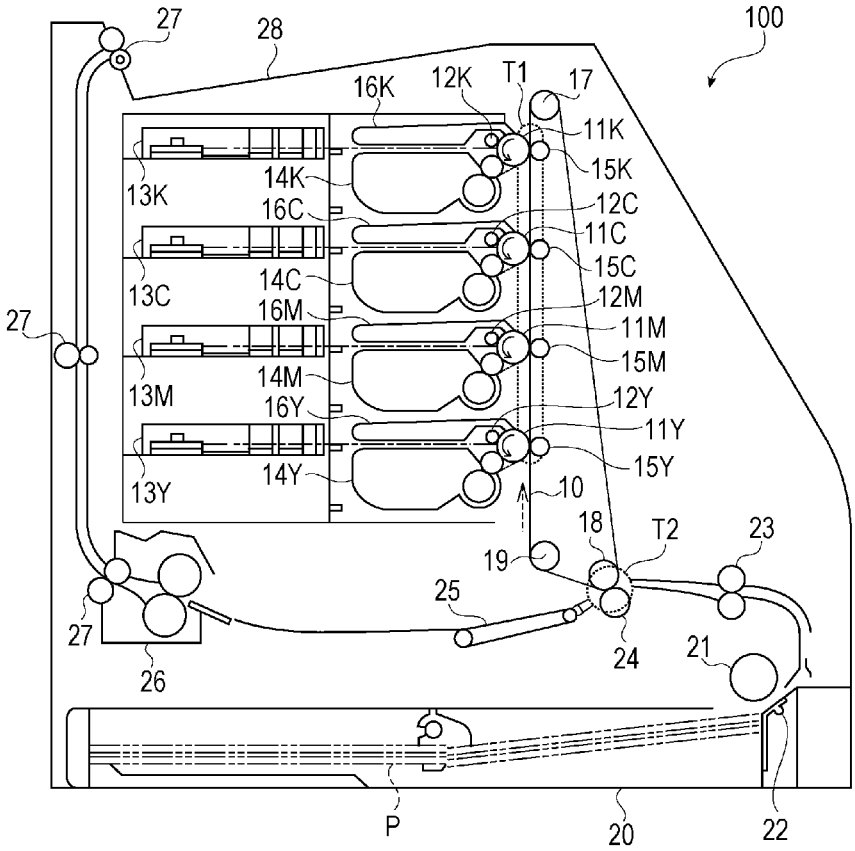
FIG. 3 is a schematic cross sectional view of an electrophotographic image forming apparatus according to the invention.

The outline of the entire configuration of the electrophotographic image forming apparatus is described. FIG. 3 is a schematic cross sectional view of a color laser beam printer according to one embodiment of an electrophotographic image forming apparatus according to the invention. A color laser beam printer (hereinafter referred to as a "printer") 100 illustrated in FIG. 3 has an image formation device having an electrophotographic photosensitive drum (hereinafter referred to as a "photosensitive drum") which rotates at a fixed speed for each color of yellow (Y), magenta (M), cyan (C), and black (K).

The color laser beam printer 100 further has an intermediate transfer body 10 which holds a color image which is developed in the image formation device and multiple-transferred, and further transfer the same to the recording medium P fed from a feeding portion. The photosensitive drums 11 (11Y, 11M, 11C, and 11K) are counterclockwise rotated and driven by drive means (not illustrated) as illustrated in FIG. 3.

Around the photosensitive drums 11, charging units (12Y, 12M, 12C, and 12K) which uniformly charge the surface of the photosensitive drums 11, scanner units 13 (13Y, 13M, 13C, and 13K) which emit a laser beam based on image information to form electrostatic latent images on the photosensitive drums 11, development units 14 (14Y, 14M, 14C, and 14K) which attach toner to the electrostatic latent images to develop the same as toner images, primary transfer rollers 15 (15Y, 15M, 15C, and 15K) which transfer the toner images on the photosensitive drums 11 to the intermediate transfer body 10 by a primary transfer portion T1, and units 16 (16Y, 16M, 16C, and 16K) each having a cleaning blade which removes untransferred residual toner remaining on the surface of the photosensitive drums 11 after transferring are disposed in this order according to the rotation direction.

In the image formation, the intermediate transfer body 10 having a belt shape stretched over the rollers 17, 18, and 19 rotates and, simultaneously therewith, the toner image of each color formed on each photosensitive drum is superimposed onto the intermediate transfer body 10 and primarily transferred, whereby a color image is formed.

The recording medium P is conveyed by conveying means to a secondary transfer portion T2 in such a manner as to synchronize with the primary transfer to the intermediate transfer body 10. The conveying means has a feeding cassette 20 containing a plurality of recording media P, a feeding roller 21, a separating pad 22, and a resist roller pair 23. In the image formation, the feeding roller 21 is driven and rotated according to the image formation operation, separates the recording media P in the feeding cassette 20 one by one, and then conveys the same to the secondary transfer portion T2 while adjusting the timing according to the image formation operation by the resist roller pair 23.

In the secondary transfer portion T2, a movable secondary transfer roller 24 is disposed. The secondary transfer roller 24 is movable in an almost vertical direction. Then, in the image transfer, the secondary transfer roller 24 is pressed against the intermediate transfer body 10 at a predetermined pressure through the recording medium P. Simultaneously therewith, bias is applied to the secondary transfer roller 24, so that the toner image on the intermediate transfer body 10 is transferred to the recording medium P.

Since the intermediate transfer body 10 and the secondary transfer roller 24 are individually driven, the recording medium P pinched therebetween is conveyed at a predetermined rate in the left direction illustrated in FIG. 3, and then further conveyed by a conveying belt 25 to a fixing portion 26 which is the following process. In the fixing portion 26, heat and pressure are applied, so that the transferred toner image is fixed onto the recording medium P. The recording medium P is discharged onto a discharge tray 28 on the upper surface of the apparatus by a discharge roller pair 27.

Then, by applying the fixing apparatus according to the invention illustrated in FIG. 2 to the fixing portion 26 of the electrophotographic image forming apparatus illustrated in FIG. 3, an electrophotographic image forming apparatus suitable for maintaining the quality of an electrophotographic image can be obtained.

As described above, the invention can provide a fixing member in which thermal degradation of silicone rubber is hard to occur and which exhibits high endurance. Moreover, the invention can provide an image heat fixing apparatus and an electrophotographic image forming apparatus which can demonstrate stable heat fixing capability for a long period of time.

EXAMPLES

The preset invention is more specifically described with reference to Examples. A fixing member used in each Example below is the fixing belt as illustrated in FIG. 2.

Example 1

The following materials (a) and (b) were blended, and then a platinum compound in a catalytic amount was added, whereby a liquid addition curable silicone rubber mixture was obtained.

(a) Vinylated polydimethylsiloxane having at least two or more vinyl groups in one molecule (Mass average molecular weight 100000 (in terms of polystyrene));

(b) Hydrogen organopolysiloxane having at least two or more Si—H bonds in one molecule (Mass average molecular weight 1500 (in terms of polystyrene))

(1) Preparation of fluororesin having phosphate group;

In a stainless steel polymerization vessel having a capacity of 4 liters and a horizontal stirring blade, 2.2 L of pure water to which 4.9 g of ammonium perfluorooctanoate was added was put. Oxygen was removed from the polymerization vessel and the temperature in the polymerization vessel was maintained at 85° C. Ethane was added to the polymerization vessel at a pressure difference of 0.03 MPa to the pressure in the vessel. Next, 104 g of perfluoro ethyl vinyl ether was added as a precharge, and then tetrafluoroethylene was added to increase the pressure in the polymerization vessel to 2.06 MPa.

69 mg of ammonium peroxodisulfate was melted in water, and then added thereto. From when the pressure decreased by 0.03 MPa, the polymerization reaction was advanced while continuously injecting ammonium peroxodisulfate and perfluoro ethyl vinyl ether into the polymerization vessel at a pressure maintained at 2.06 MPa with tetrafluoroethylene.

The polymerization was performed at a temperature of 85° C. and at a pressure of 2.06 MPa. After 110 minute passed after starting the reaction, 0.6% by mass of an aqueous solution of 2,2,3,3,5,6,6,8,9,9-decafluoro-5-trifluoromethyl-4,7-dioxanona-8-en-1-yl dihydrogen phosphate (hereinafter also referred to as an "aqueous EVE-P solution) was added at a rate of 26 ml/min for 10 minutes. Simultaneously with the completion of the addition of the aqueous EVE-P solution, stirring was stopped to terminate the reaction.

The ammonium peroxodisulfate added during the reaction was 100 mg and the perfluoro ethyl vinyl ether added during the reaction was 84 g.

After removing polymerization residual gas from the polymerization vessel, the polymerization vessel was opened, and then a cloudy dispersion liquid containing an about 30% by mass of a solid content was obtained. The solid contained in the cloudy dispersion liquid was frozen and condensed, washed with water and acetone, and then dried, whereby PFA to which a phosphate group was bonded was obtained.

(2) Preparation of Sheet-Shaped Silicone Rubber Cured Body;

300 parts by mass of spherical alumina (Trade name: Alunabeads CB-A10S, manufactured by Showa Denko K.K., Sodium concentration is 400 ppm) as a thermally conductive filler and 16 parts by mass of the PFA having a phosphate group prepared in (1) above based on 100 parts by mass of the addition curable silicone rubber mixture were compounded and kneaded. The resultant substance is referred to as an elastic layer formation raw-material mixture 1.

The elastic layer formation raw-material mixture 1 was press-molded into a 2 mm thick sheet at a temperature of 130° C. for 15 minutes, and thereafter heated for 4 hours in an electric oven whose temperature was set to 200° C., whereby a silicone rubber cured body in a shape of a 2 mm thick sheet was obtained. Hereinafter, the silicone rubber cured body thus obtained is also referred to as a "sheet-shaped silicone rubber cured body". The following evaluation test 1 was performed using the sheet-shaped cured silicone rubber.

(2) Preparation of Fixing Belt;

As a substrate, a nickel electrocast endless belt with an inner diameter of 30 mm, a width of 400 mm, and a thickness 40 μm was prepared. The outer circumferential surface of the endless belt was treated with a primer.

To the outer circumferential surface of the endless belt treated with a primer, the elastic layer formation raw-material mixture 1 prepared in (1) above was applied with a thickness of 300 μm using a ring coating method.

Subsequently, the endless belt was heated for 15 minutes in an electric furnace whose temperature was set to 130° C. Subsequently, the resultant endless belt was heated for 4 hours in an electric furnace whose temperature was set to 200° C., and then the organopolysiloxane in the addition curable silicone rubber mixture was made to react, whereby a silicone rubber elastic layer was formed.

Thereafter, a fluororesin primer was applied to the surface of the silicone rubber elastic layer, and then a PFA tube with a thickness of 20 μm whose inner surface was subjected to etching treatment was placed thereon. Then, the fluororesin primer was cured to thereby prepare a fixing belt according to this example.

<Evaluation Test 1; Seal Aging Test>

In this evaluation test, the state of degradation of the fixing member caused by the heat of the elastic layer was evaluated using the sheet-shaped silicone rubber cured body prepared in (1) above.

The elastic layer in the fixing member in which the substrate, the elastic layer, and the surface layer are laminated in this order is sandwiched between the substrate and the surface layer in the state where it is placed in the image heat fixing apparatus and operates. Therefore, the state where the elastic layer was heated to 200° C. or higher continues for a long period of time under an environment where the supply of oxygen was restricted.

Herein, oxygen enters a cut portion of the crosslinked structure of the silicone rubber to contribute to the reproduction of the crosslinked structure of the cut silicone rubber. Therefore, the formation of a new crosslinked structure due to the entering of oxygen atoms is hard to occur in the silicone rubber elastic layer which is heated where the supply of oxygen is restricted, and therefore the hardness particularly significantly changes.

Then, in order to evaluate the hardness change of the silicone rubber elastic layer in actual use where the supply of oxygen to the silicone rubber elastic layer is restricted, a sample of the silicone rubber cured body cut out from the elastic layer was wrapped with aluminum foil, and then exposed to a high temperature environment where the inflow of air was restricted in this evaluation test.

Specifically, a large number of evaluation samples, which were obtained by cutting the previously prepared sheet-shaped silicone rubber cured body into a size of Length of 20 mm×Width of 20 mm, and then laminating two sheets thereof, were prepared. Each evaluation sample was sealed using 20 μm thick aluminum foil. Each evaluation sample was put in an electric oven whose temperature was set to 230° C., and then heated. Then, the micro hardness of each evaluation sample was measured according to the heating time using a micro rubber hardness meter (Trade name: MD-1 capa type C; manufactured by KOBUNSHI KEIKI CO., LTD.). The measurement of the micro hardness was performed for each evaluation sample before put into the electric oven (heated) and 1 hour after, 5 hours after, 10 hours after, 20 hours after, 30 hours after, 50 hours after, 70 hours after, 100 hours after, 150 hours after, 200 hours after, and 250 hours after put into the electric oven.

As a result, the softening caused by the heating notably occurred immediately after put into the electric oven, and the hardness became the lowest hardness within about 100 hours. After that, the curing caused by connection of the cut portions of the crosslinked structure predominantly proceeded, so that the change in the micro hardness changed to an increase tendency.

In this evaluation, the maximum hardness decreasing rate was calculated according to the following equation using the value (initial value) of the evaluation sample before put into the electric oven and the value of the evaluation sample with the lowest micro hardness value. The results are collectively shown in Table 2.

Maximum hardness decreasing rate=[(Micro hardness before heating−Micro hardness after heating)/Micro hardness before heating]×100

<Evaluation Test 2: Endurance Test as Fixing Member>

In this evaluation test, the fixing belt prepared in (2) above is placed in an electrophotographic image forming apparatus, and then the endurance of the fixing belt is evaluated.

The image heat fixing apparatus illustrated in FIG. 2 in which the fixing belt obtained in (2) above was placed was placed in a monochrome laser beam printer (Trade name: Laserjet P4515, manufactured by HP). Halftone images were continuously output using the laser beam printer on A4 size paper (Trade name: PB PAPER GF-500, manufactured by CANON KABUSHIKI KAISHA, 68 g/m$^2$). The resolution of the images was set to 600 dpi. With respect to the halftone images output herein, horizontal lines with a width of 1 dot and an interval of 2 dots were formed in the direction orthogonal to the rotation direction of a photosensitive member. With respect to the evaluation, the obtained halftone images were visually observed for the presence or absence of the uneven density resulting from wrinkles and the like formed on the surface of the fixing belt, and then the number of the halftone images in which the image unevenness appeared first was recorded.

As a result, in this example, the occurrence of "wrinkles" on the surface of the fixing belt was not recognized even after the formation of 15,000 images, and the occurrence of uneven density in the halftone images resulting from the wrinkles was not recognized.

Example 2

An elastic layer formation raw-material mixture 2 was prepared in the same manner as in Example 1, except changing the addition amount of the phosphoric acid grafted fluororesin in the elastic layer formation raw-material mixture to 8 parts by mass.

A sheet-shaped silicone rubber cured body was prepared in the same manner as in (1) of Example 1, except using the elastic layer formation raw-material mixture 2, and then subjected to the evaluation test 1. The results are collectively shown in Table 2.

A fixing belt was formed in the same manner as in (2) of Example 1, except using the elastic layer formation raw-material mixture 2, and then subjected to the evaluation test 2.

As a result, the occurrence of "wrinkles" on the surface of the fixing belt was not recognized even after the formation of 15,000 images and the occurrence of uneven density and the like in the halftone images was also not recognized.

Example 3

An elastic layer formation raw-material mixture 3 was prepared in the same manner as in Example 1, except changing the phosphoric acid grafted fluororesin to zirconium phosphate (Trade name: IXE-100, manufactured by TOAGOSEI CO., LTD.).

A sheet-shaped silicone rubber cured body was prepared in the same manner as in (1) of Example 1, except using the elastic layer formation raw-material mixture 3, and then subjected to the evaluation test 1. The results are collectively shown in Table 2.

A fixing belt was formed in the same manner as in (2) of Example 1, except using the elastic layer formation raw-material mixture 3, and then subjected to the evaluation test 2. As a result, the occurrence of "wrinkles" on the surface of the fixing belt was not recognized even after the formation of 15,000 images, and the occurrence of uneven density in the halftone images was also not recognized.

Example 4

An elastic layer formation raw-material mixture 4 was obtained in the same manner as in Example 1, except changing the addition amount of the zirconium phosphate to 6 parts by mass.

A sheet-shaped silicone rubber cured body was prepared in the same manner as in (1) of Example 1, except using the elastic layer formation raw-material mixture 4, and then subjected to the evaluation test 1. The results are collectively shown in Table 2.

A fixing belt was formed in the same manner as in (2) of Example 1, except using the elastic layer formation raw-material mixture 4, and then subjected to the evaluation test 2. As a result, the occurrence of "wrinkles" on the surface of the fixing belt was not recognized even after the formation of 15,000 images and the occurrence of uneven density and the like in the halftone images was also not recognized.

Comparative Example 1

An elastic layer formation raw-material mixture C-1 was obtained in the same manner as in Example 1, except not using a phosphate compound.

A sheet-shaped silicone rubber cured body was prepared in the same manner as in (1) of Example 1, except using the elastic layer formation raw-material mixture C-1, and then subjected to the evaluation test 1. The results are collectively shown in Table 2.

A fixing belt was formed in the same manner as in (2) of Example 1, except using the elastic layer formation raw-material mixture C-1, and then subjected to the evaluation test 2. As a result, the occurrence of wrinkles was recognized on the surface of the fixing belt from approximately the 7000th image and uneven density resulting from the wrinkles began to appear in the halftone images.

Comparative Example 2

An elastic layer formation raw-material mixture C-2 was prepared in the same manner as in Example 1, except compounding 16 parts by mass of fluororesin (PFA) powder having the same true density as that of the phosphoric acid grafted fluororesin as a phosphoric acid grafted fluororesin.

A sheet-shaped silicone rubber cured body was prepared in the same manner as in (1) of Example 1, except using the elastic layer formation raw-material mixture C-2, and then subjected to the evaluation test 1. The results are collectively shown in Table 2.

A fixing belt was formed in the same manner as in (2) of Example 1, except using the elastic layer formation raw-material mixture C-2, and then subjected to the evaluation test 2. As a result, the occurrence of wrinkles was recognized on the surface of the fixing belt from approximately the 7000th image and uneven density resulting from the wrinkles began to appear in the halftone images.

Example 5

An elastic layer formation raw material mixture 5 was obtained in the same manner as in Example 1, except compounding 320 parts by mass of zinc oxide containing sodium in a proportion of 550 ppm in place of alumina.

A sheet-shaped silicone rubber cured body was prepared in the same manner as in (1) of Example 1, except using the elastic layer formation raw-material mixture 5, and then subjected to the evaluation test 1. The results are collectively shown in Table 2.

A fixing belt was formed in the same manner as in (2) of Example 1, except using the elastic layer formation raw-material mixture 5, and then subjected to the evaluation test 2. As a result, the occurrence of "wrinkles" on the surface of the fixing belt was not recognized even after the formation of 15,000 images and the occurrence of uneven density in the halftone images was also not recognized.

Example 6

An elastic layer formation raw-material mixture 6 was obtained in the same manner as in Example 5, except changing the addition amount of the phosphoric acid grafted fluororesin to 8 parts by mass.

A sheet-shaped silicone rubber cured body was prepared in the same manner as in (1) of Example 1, except using the elastic layer formation raw-material mixture 6, and then subjected to the evaluation test 1. The results are collectively shown in Table 2.

A fixing belt was formed in the same manner as in (2) of Example 1, except using the elastic layer formation raw-material mixture 6, and then subjected to the evaluation test 2. As a result, the occurrence of "wrinkles" on the surface of the fixing belt was not recognized even after the formation of 15,000 images and the occurrence of uneven density in the halftone images was also not recognized.

Comparative Example 3

An elastic layer formation raw material mixture C-3 was obtained in the same manner as in Example 5, except not using a phosphate compound.

A sheet-shaped silicone rubber cured body was prepared in the same manner as in (1) of Example 1, except using the elastic layer formation raw-material mixture C-3, and then subjected to the evaluation test 1. The results are collectively shown in Table 2.

A fixing belt was formed in the same manner as in (2) of Example 1, except using the elastic layer formation raw-material mixture C-3, and then subjected to the evaluation test 2. As a result, the occurrence of wrinkles was recognized on the surface of the fixing belt from approximately the 6000th image and uneven density resulting from the wrinkles began to appear in the halftone images.

The thermally conductive fillers and the phosphate compounds of Examples 1 to 5 and Comparative Examples 1 to 3 are collectively shown in Table 1.

TABLE 1

| | Thermally conductive filler | | | Phosphate compound | |
|---|---|---|---|---|---|
| | Filler type | Sodium concentration (ppm) | Addition amount (part by mass) | Compound Type | Addition amount (part by mass) |
| Example 1 | Alumina | 400 | 300 | Phosphate group-bonded fluororesin | 16 |
| Example 2 | Alumina | 400 | 300 | Phosphate group-bonded fluororesin | 8 |
| Example 3 | Alumina | 400 | 300 | Zirconium phosphate | 16 |
| Example 4 | Alumina | 400 | 300 | Zirconium phosphate | 6 |
| Comparative Example 1 | Alumina | 400 | 300 | None | — |
| Comparative Example 2 | Alumina | 400 | 300 | *Fluororesin (PFA) powder | 16 |
| Example 5 | Zinc oxide | 550 | 320 | Phosphate group-bonded fluororesin | 16 |
| Example 6 | Zinc oxide | 550 | 320 | Phosphate group-bonded fluororesin | 8 |
| Comparative Example 3 | Zinc oxide | 550 | 320 | None | — |

*The fluororesin (PFA) powder used in Comparative Example 2 is PFA not having a phosphate group.

The results of the evaluation test 1 for the sheet-shaped silicone rubber cured bodies of Examples 1 to 5 and Comparative Examples 1 to 3 are shown in Table 2.

TABLE 2

| | Evaluation test 1 Maximum hardness decreasing rate (%) |
|---|---|
| Example 1 | 10 |
| Example 2 | 17 |
| Example 3 | 16 |
| Example 4 | 20 |
| Comparative Example 1 | 24 |
| Comparative Example 2 | 23 |
| Example 5 | 15 |
| Example 6 | 20 |
| Comparative Example 3 | 27 |

As shown by the results above, the maximum hardness decreasing rate was suppressed in each Example rather than in Comparative Example thereof, and when placed in an actual device (color laser beam printer) and used, image defects and wrinkles did not occur. On the other hand, in Comparative Examples, the maximum hardness decreasing rate was high and image defects and wrinkles occurred in the endurance test in an actual device. This is considered to occur due to the following reason. When the maximum hardness decreasing rate in the sealing aging test is high, a reduction in the hardness is high also in the cured silicone rubber elastic layer when placed in an actual device and used, and therefore wrinkles were formed on the fixing belt surface due to deformation and image defects occurred.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-172347 filed Aug. 2, 2012 and No. 2013-131199 filed Jun. 21, 2013, which are hereby incorporated by reference herein in their entirety.

What is claimed is:

1. A fixing member, comprising a substrate, a cured silicone rubber elastic layer, and a surface layer in this order, the cured silicone rubber elastic layer containing:

a thermally conductive filler containing an alkali metal ion, and a compound having a phosphate group in a molecule.

2. The fixing member according to claim 1, wherein the alkali metal ion is a sodium ion.

3. The fixing member according to claim 1, wherein the compound having a phosphate group in the molecule is zirconium phosphate.

4. The fixing member according to claim 1, wherein the compound having a phosphate group in the molecule is a fluororesin to which a phosphate group is bonded.

5. The fixing member according to claim 4, wherein the fluororesin to which a phosphate group is bonded is a tetrafluoroethylene-perfluoroalkyl vinyl ether copolymer having a phosphate group.

6. The fixing member according to claim 1, wherein a content of the compound having a phosphate group in the molecule in the elastic layer is 0.2% by mass or more and 10% by mass or lower relative to the silicone rubber in the elastic layer.

7. The fixing member according to claim 1, wherein the thermally conductive filler contains at least one of alumina and zinc oxide.

8. The fixing member according to claim 1, wherein a content of the thermally conductive filler in the elastic layer is 35% by volume or more and 60% by volume or lower relative to the elastic layer.

9. The fixing member according to claim 1, wherein the surface layer contains a fluororesin.

10. An image heat fixing apparatus, comprising the fixing member according to claim 1, a unit configured to heat the fixing member, and a pressure member opposingly disposed to the fixing member.

11. An electrophotographic image forming apparatus, comprising the image heat fixing apparatus according to claim 10.

* * * * *